US006382389B1

(12) United States Patent
Mehlert et al.

(10) Patent No.: US 6,382,389 B1
(45) Date of Patent: May 7, 2002

(54) HEATED ESCALATOR HANDRAIL

(75) Inventors: Hans-Martin Mehlert, Nienstaedt; Dietmar Krüger, Rinteln, both of (DE)

(73) Assignee: Otis Elevator Company, Farmington, CT (US)

( * ) Notice: Subject to any disclaimer, the term of this patent is extended or adjusted under 35 U.S.C. 154(b) by 95 days.

(21) Appl. No.: 09/116,409

(22) Filed: Jul. 16, 1998

(51) Int. Cl.[7] ..... B66B 23/22
(52) U.S. Cl. ..... 198/335; 198/494
(58) Field of Search ..... 198/335, 337, 198/494, 952

(56) References Cited

U.S. PATENT DOCUMENTS

| | | | | |
|---|---|---|---|---|
| 2,839,651 A | * | 6/1958 | Erickson | 198/952 |
| 4,871,056 A | * | 10/1989 | Saito | 198/335 |
| 4,927,003 A | * | 5/1990 | Swinderman et al. | 198/952 |
| 5,014,844 A | * | 5/1991 | Anttonen | 198/952 |
| 5,798,038 A | * | 8/1998 | Huber | 198/952 |

* cited by examiner

*Primary Examiner*—Joseph E. Valenza

(57) ABSTRACT

A handrail guide in an outdoor escalator contains a heating cable to prevent the handrail from freezing to an associated handrail guide in cold weather.

3 Claims, 1 Drawing Sheet

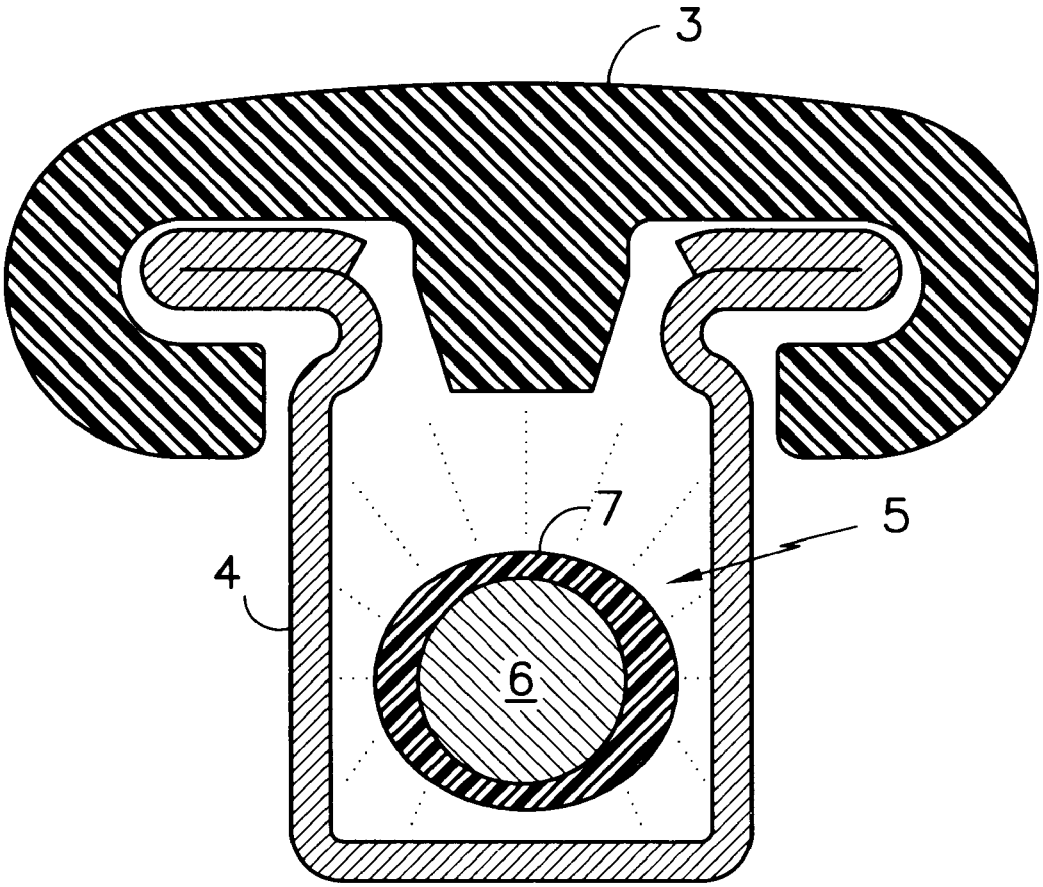
3
7
5
4
6

HEATED ESCALATOR HANDRAIL

TECHNICAL FIELD

This invention relates to an outdoor escalator handrail guide containing a heating cable to keep the handrail from freezing to the handrail guide in extreme cold outdoor conditions.

BACKGROUND ART

During the wintertime, it is necessary to operate an outdoor escalator continuously. If it were switched off, the handrail would freeze to the handrail guide, and if such occurs, the escalator should not be started again, because parts of the handrail guide can be disturbed or damaged. The handrail can also become brittle or stiff, and may break if the system is restarted.

DISCLOSURE OF THE INVENTION

Objects of the invention include allowing an outdoor escalator to be turned off at night or when needed.

According to the present invention, a heating cable is disposed within the handrail guide of an outdoor escalator.

The heating cable allows for the escalator to be turned off at night, or when need arises, while keeping the handrail from freezing. The present invention provides a heating cable which is easy to install and maintain.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole FIGURE herein is a cross-sectional view of the handrail guide, containing the heating cable.

BEST MODE FOR CARRYING OUT THE INVENTION

Referring now to the sole FIGURE herein, a conventional escalator handrail 3, made of semirigid plastic, slides along a conventional handrail guide 4. In cold temperatures it has been found that moisture in the air can cause the handrail 3 to freeze to the handrail guide 4 if the escalator is shut off. When this occurs the escalator should not be started, because damage to the handrail 3 or handrail guide 4 can result.

To prevent this problem, a conventional heating cable 5, comprised of a resistive conductor 6 and an insulation layer 7, is installed inside the handrail guide 4. The heating cable 5 warms the handrail 3 from the inside, and thus keeps it from freezing, thereby allowing the escalator to be shut off when not in use.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A method of preventing a handrail of an outdoor escalator from freezing which comprises heating a handrail guide associated with said handrail.

2. A method according to claim 1, wherein said step of heating comprises heating the inside of said handrail guide with an electric heating cable.

3. An escalator, comprising:

a semirigid handrail;

a handrail guide associated with said handrail; and a heating cable disposed within said handrail guide.

* * * * *